US011926955B2

(12) United States Patent
Yoon et al.

(10) Patent No.: US 11,926,955 B2
(45) Date of Patent: Mar. 12, 2024

(54) LAUNDRY DRYER AND METHOD FOR CONTROLLING THE SAME

(71) Applicant: LG Electronics Inc., Seoul (KR)

(72) Inventors: Juhan Yoon, Seoul (KR); Manseok Lee, Seoul (KR); Hyojin Joo, Seoul (KR)

(73) Assignee: LG Electronics Inc., Seoul (KR)

( * ) Notice: Subject to any disclaimer, the term of this patent is extended or adjusted under 35 U.S.C. 154(b) by 281 days.

(21) Appl. No.: 17/191,147

(22) Filed: Mar. 3, 2021

(65) Prior Publication Data

US 2021/0277587 A1 Sep. 9, 2021

(30) Foreign Application Priority Data

Mar. 4, 2020 (KR) ..... 10-2020-0027321

(51) Int. Cl.

| | |
|---|---|
| ***D06F 58/44*** | (2020.01) |
| ***D06F 58/20*** | (2006.01) |
| ***D06F 103/62*** | (2020.01) |
| ***D06F 105/60*** | (2020.01) |
| ***D06F 105/62*** | (2020.01) |

(52) U.S. Cl.

CPC ..... *D06F 58/44* (2020.02); *D06F 58/203* (2013.01); *D06F 2103/62* (2020.02); *D06F 2105/60* (2020.02); *D06F 2105/62* (2020.02)

(58) Field of Classification Search

CPC .... D06F 58/44; D06F 58/203; D06F 2103/62; D06F 2105/60; D06F 2105/62; D06F 33/30; D06F 34/14; D06F 39/008; D06F 39/085; D06F 58/04; D06F 2105/40; D06F 2105/58; D06F 58/38; D06F 58/20; D06F 58/36; D06F 2103/56; D06F 2105/28; D06F 2105/30; D06F 33/54; D06F 58/12; D06F 58/34

See application file for complete search history.

(56) References Cited

U.S. PATENT DOCUMENTS 8,931,186 B2 * 1/2015 Choi ..... D06F 58/30 34/443

2008/0302138 A1 12/2008 Bae et al.

FOREIGN PATENT DOCUMENTS

KR 1020080107788 12/2008

OTHER PUBLICATIONS

EP Extended European Search Report in European Appln. No. 21159932.9, dated Jul. 5, 2021, 8 pages.

* cited by examiner

*Primary Examiner* — Jessica Yuen

(74) *Attorney, Agent, or Firm* — Fish & Richardson P.C.

(57) ABSTRACT

A laundry dryer performs a method for drying laundry with steam or hot air and notifying a user of water shortage. The laundry dryer includes a cabinet, a drum, a steam unit, a storage tank, a supply pump, and a steam controller. The steam controller operates the steam unit upon receiving a steam supply command to supply steam to the drum. When a water level of water stored in at least one of the steam unit or the storage tank is equal to or less than a predetermined water level, the steam controller provides a water shortage notification message for user recognition. The laundry dryer provides the water shortage notification message when a minimum amount of residual water is stored in the storage tank. The number of times to refill the storage tank can be minimized, resulting in an increase in user convenience.

9 Claims, 6 Drawing Sheets

LAUNDRY DRYER AND METHOD FOR CONTROLLING THE SAME

CROSS-REFERENCE TO RELATED APPLICATION

This application claims the benefit of Korean Patent Application No. 10-2020-0027321, filed on Mar. 4, 2020, which is hereby incorporated by reference as if fully set forth herein.

TECHNICAL FIELD

The present disclosure relates to a laundry dryer and a method for controlling the same, and more particularly to a laundry dryer for informing a user of water shortage in a situation in which a minimum amount of residual water is stored in a storage tank designed to store water needed to generate steam, and a method for controlling the same.

BACKGROUND

A laundry dryer may supply hot air to the inside of a drum in a situation in which laundry (e.g., clothes or bedclothes) to be dried is put into the rotating drum, such that the laundry dryer can remove moisture or humidity from the laundry to be dried.

Hot air to be supplied to the inside of the drum may be produced by electric resistance heat, combustion heat caused by a gas fuel, or a condenser constituting a heat pump cycle, such that the hot air can be supplied to the inside of the drum by activation of a circulation fan.

After laundry to be dried has been dehumidified and dried in the drum, air scheduled to exit the drum unavoidably includes moisture removed from the laundry, such that the resultant air is in a high temperature and humid state. In this case, dryers can be classified into a condensation-type dryer and an exhaust-type dryer according to methods of treating the air of high temperature and humidity.

The condensation-type dryer does not discharge the high temperature and humid air to the outside, and condenses moisture contained in the high temperature and humid air through heat exchange while allowing the high temperature and humid air to circulate therein. In contrast, the exhaust-type dryer directly discharges the high temperature and humid air to the outside. The condensation-type dryer is different in structure from the exhaust-type dryer in that condensation-type dryer has a structure for treating condensate water and the exhaust-type laundry dryer has a structure for exhausting the air.

On the other hand, in order to improve the drying efficiency of laundry, a laundry dryer having a means capable of spraying steam into the drum to sterilize laundry to be dried and the drum has been developed.

Korean Patent Laid-Open Publication No. 10-2008-0056500 has disclosed a steam spray-type laundry dryer that directly receives water for steam generation from an external water supply source, or receives such water for steam generation from a storage tank installed in the laundry dryer.

According to a conventional laundry dryer designed to supply water to a steam unit using the storage tank, when water stored in the storage tank is exhausted, a user separates the storage tank from the laundry dryer, refills the storage tank with water, and re-installs the storage tank in the laundry dryer, such that the storage tank of the laundry dryer can be replenished with water required for steam generation.

In this case, a water level sensor is installed in the storage tank to determine a level of residual water stored in the storage tank, such that the conventional laundry dryer can determine a water level of the residual water stored in the storage tank using the water level sensor. If there is a need to refill the storage tank with water, a water shortage notification message may be displayed on the laundry dryer such that the user can recognize such water shortage state of the storage tank.

Generally, a reed switch may be used as a water level sensor capable of measuring a water level of water stored in the storage tank. If the water level sensor is implemented as a reed switch, a water level measured when at least a predetermined amount of water remains in the storage tank due to a restricted sensing range of the water level sensor is determined to be a minimum water level.

Therefore, the conventional laundry dryer notifies the user of a water shortage state of the storage tank in a situation in which at least a predetermined amount of water remains in the storage tank. As a result, the user should refill (or replenish) the storage tank with water even though at least a predetermined amount of residual water is stored in the storage tank, resulting in user inconvenience.

In addition, the conventional laundry dryer unavoidably notifies the user of a water shortage state using a notification message even when a predetermined amount of water is stored in the storage tank, and the user may mistake the notification message for a malfunction.

SUMMARY

Accordingly, the present disclosure is directed to a laundry dryer and a method for controlling the same that substantially obviate one or more problems due to limitations and disadvantages of the related art.

An object of the present disclosure is to provide a laundry dryer capable of informing a user of a water shortage state indicating that a water level of water stored in a storage tank does not reach a target water level for enabling a steam unit to generate steam, and a method for controlling the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

When the steam unit is not filled with water corresponding to a target water level, the laundry dryer may determine a water shortage state, such that the laundry dryer can provide a water shortage notification message in a situation in which the amount of residual water stored in the storage tank is minimized.

To achieve these objects and other advantages and in accordance with the purpose of the invention, as embodied and broadly described herein, a laundry dryer may include a cabinet; a drum rotatably supported in the cabinet, and configured to receive hot air and steam; a steam unit disposed in the cabinet, and configured to generate the steam; a storage tank disposed in the cabinet, and configured to store water to be supplied to the steam unit; a supply pump disposed between the steam unit and the storage tank, and configured to transfer water stored in the storage tank to the steam unit; and a steam controller configured to operate the steam unit upon receiving a steam supply command so that the steam is supplied to the drum. If a water level of at least one of water stored in the steam unit and water stored in the storage tank is equal to or less than a predetermined water level, the steam controller may provide a water shortage notification message for user recognition.

If a water level of at least one of water stored in the steam unit and water stored in the storage tank is equal to or less than a predetermined water level, the steam controller may provide a water shortage notification message such that the user can recognize the water shortage notification message.

If steam is completely sprayed into the drum, the steam controller may operate the supply pump in a manner that the steam unit is filled with water corresponding to a predetermined target water level, so that water is supplied to the steam unit.

Although a predetermined time has elapsed from an operation start time of the supply pump, if the steam unit is not filled with water corresponding to the target water level, the steam controller may determine a water shortage state of the storage tank, and provides a water shortage notification message.

When determining the water shortage state of the storage tank, the steam controller may provide the water shortage notification message at any one of a first time where the water shortage state of the storage tank is determined and a second time where a subsequent steam supply command is input.

The steam unit may include a steam generator configured to store water received from the storage tank so as to generate steam, a spray nozzle configured to spray the steam generated by the steam generator into the drum, a water supply pipe configured to connect the supply pump to the steam unit so as to supply water stored in the storage tank to the steam generator, and a steam discharge pipe configured to connect the steam generator to the spray nozzle so that the steam generated by the steam generator is supplied to the spray nozzle.

The steam generator may include a steam housing configured to receive water received from the storage tank, a heater configured to heat water stored in the steam housing, and a water level sensor configured to measure a water level of the water stored in the steam housing.

The water level sensor may include a low water level sensor configured to measure a predetermined minimum water level in a manner that the heater is always immersed in the water stored in the steam housing, and a high water level sensor configured to measure the target water level to be stored in the steam housing for steam generation.

The water level sensor may include a low water level electrode installed at a position corresponding to the minimum water level to be stored in the steam housing, a high water level electrode installed at a position corresponding to the target water level to be stored in the steam housing for steam generation, and a common electrode installed at a position that is identical to or lower than that of the low water level electrode, and configured to be electrically connected to at least one of the low water level electrode and the high water level electrode through water stored in the steam housing, thereby recognizing a water level of stored water.

Although a predetermined time has elapsed from an operation start time of the supply pump, if the target water level is not satisfied, the steam controller may provide a water shortage notification message.

If the water level of water stored in the steam housing does not satisfy the minimum water level, the steam controller may operate the supply pump such that the minimum water level is satisfied.

The steam controller may provide the water shortage notification message through at least one of a display panel and a speaker.

In accordance with a method for controlling the laundry dryer, if the steam unit is not filled with water corresponding to a predetermined target water level, the water shortage state is determined, such that the laundry dryer can provide a water shortage notification message in a situation in which the amount of the residual water stored in the storage tank is minimized.

In accordance with another aspect of the present disclosure, a method for controlling a laundry dryer that dries laundry by supplying hot air and steam to a drum in which the laundry is placed may include, if a drying process is performed, supplying hot air to the drum, if a drying process is performed, supplying the steam to the drum through a steam unit, if steam supply is completed, supplying water stored in a storage tank to the steam unit by operating a supply pump, after water is completely supplied to the steam unit, if a water level of at least one of water stored in the steam unit and water stored in the storage tank is equal to or less than a predetermined water level, determining a water shortage state, and performing water shortage notification for displaying a water shortage notification message for user recognition.

The supplying the water stored in the storage tank to the steam unit may include supplying water by operating the supply pump until a water level of water stored in the steam unit satisfies a predetermined target water level, and if the target water level is satisfied or if a predetermined time has elapsed, stopping operation of the supply pump.

The supplying the water stored in the storage tank to the steam unit may include, if a predetermined time has elapsed from a specific time where there is no change in a current applied to the supply pump and load is not applied to the supply pump, stopping operation of the supply pump.

The determining the water shortage state may include, after lapse of a predetermined time in the supplying of the water, if the supply pump is stopped, determining that the target water level is not satisfied, thereby determining a water shortage state.

The performing the water shortage notification may include providing a water shortage notification message when the water shortage state is determined.

The performing the water shortage notification may include providing a water shortage notification message when a subsequent steam supply command is input.

The determining the water shortage state may include recognizing a water level of water stored in the storage tank, recognizing a water level of water stored in the steam unit, and if the water level of water stored in the storage tank is equal to or less than a predetermined water level, and if the water level of water stored in the steam unit does not satisfy the target water level, determining the water shortage state.

The performing the water shortage notification may include providing the water shortage notification message through at least one of a display panel and a speaker.

The method may further include, if a new drying process command is input after execution of the water shortage notification, and if the water level of water stored in the steam unit satisfies the target water level, proceeding to the supplying of the hot air.

It is to be understood that both the foregoing general description and the following detailed description of the present disclosure are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Reference will now be made in detail to the embodiments of the present disclosure, examples of which are illustrated in the accompanying drawings. Wherever possible, the same reference numbers will be used throughout the drawings to refer to the same or similar parts. In the following description, a detailed description of related known configurations or functions incorporated herein will be omitted to avoid obscuring the subject matter.

A laundry dryer and a method for controlling the same according to embodiments of the present disclosure will hereinafter be described with reference to the attached drawings.

Figure 1:
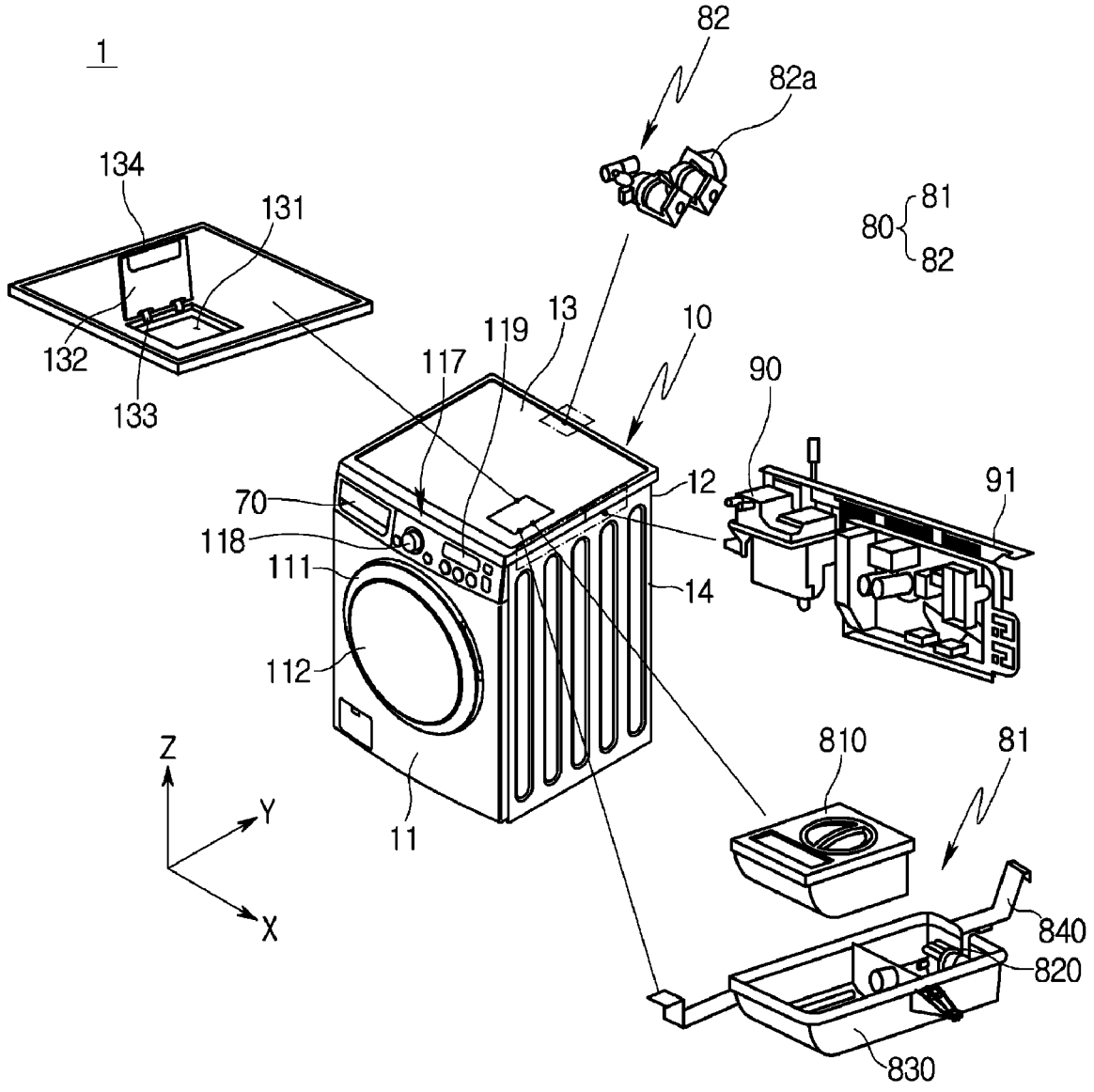
FIG. 1 is a perspective view illustrating a laundry dryer according to the present disclosure.
Figure 2:
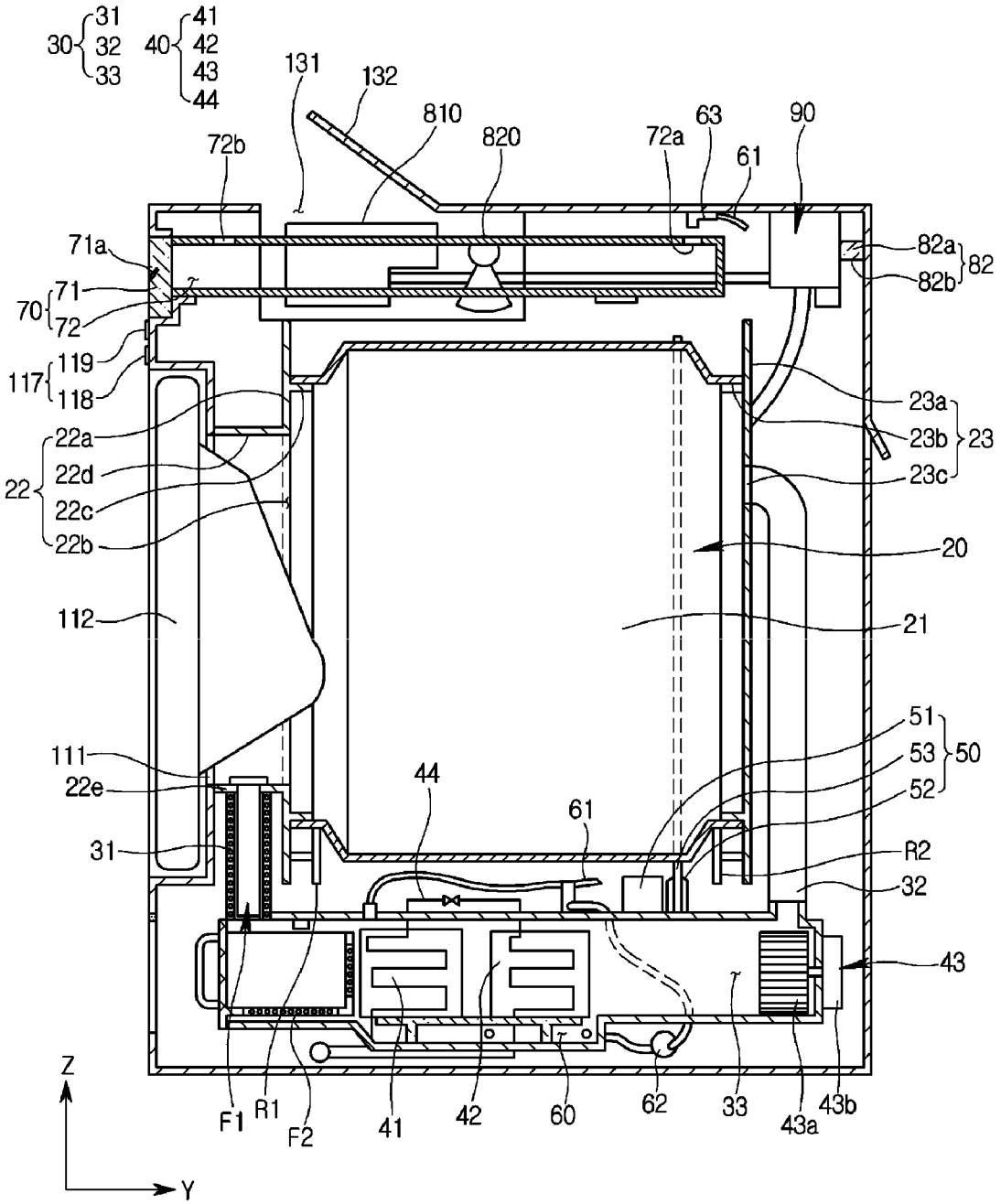
FIG. 2 is a cross-sectional view illustrating a laundry dryer according to the present disclosure.

FIG. 1 is a perspective view illustrating a laundry dryer 1 according to the present disclosure. FIG. 2 is a cross-sectional view illustrating the laundry dryer 1 according to the present disclosure.

Referring to FIGS. 1 and 2, a cabinet 10 forming an outer body of the laundry dryer 1 may include a front panel 11 to construct a front surface of the laundry dryer 1, a back panel 12 to construct a back surface of the laundry dryer 1, a pair of side panels 14 to construct side surfaces of the laundry dryer 1, and a top panel 13 to construct a top surface of the laundry dryer 1.

The front panel 11 may include an inlet 111 formed to communicate with a drum 20 to be described later, and a door 112 rotatably coupled to the cabinet 10 to open or close the inlet 111.

The front panel 11 may include a control panel 117.

The control panel 117 may include an input unit 118 to receive a control command from a user, a display unit 119 to display information such as a user-selectable control command thereon, and a main controller (not shown) to control a command required for performing procedures of the laundry dryer 1.

The input unit 118 may include a power-supply request unit for requesting power supply from the laundry dryer 1, a course input unit for selecting a user-desired course from among a plurality of courses, an execution request unit for requesting initiation of the user-selected course, and so on.

The display unit 119 may include at least one of a display panel and a speaker. The display panel may display and output characters and/or figures. The speaker may output a voice signal and a sound signal. The user who views information displayed on the display unit 119 can easily recognize a situation, a residual time, etc. of a current operating procedure of the laundry dryer 1.

The cabinet 10 may include a drum 20, a duct unit 30, and a heat exchanger unit 40. The drum 20 may be rotatably installed in the cabinet 10, and may provide a space in which laundry is placed. The duct unit 30 may form a flow passage through which air discharged from the drum 20 is re-supplied to the drum 20. The heat exchanger unit 40 may dehumidify and heat the air introduced into the duct unit 30, and may re-supply the heated air to the drum 20.

The drum 20 may include a cylindrical drum body 21, a front surface of which is opened. The cabinet 10 may include a first support 22 and a second support 23. The first support 22 may rotatably support the front surface of the drum body 21. The second support 23 may rotatably support the back surface of the drum body 21.

The first support 22 may include a first fixed body 22*a* fixed into the cabinet 10, a drum inlet 22*b* formed to pass through the first fixed body in a manner that the inlet 111 can communicate with the inside of the drum body 21, and a first support body 22*c* installed in the first fixed body 22*a* such that the first support body 22*c* is inserted into the front surface of the drum body 21.

The first support 22 may further include a connection body 22*d* for connecting the inlet 111 to the drum inlet 22*b*. As illustrated in FIG. 2, the connection body 22*d* may be formed in a pipe shape extending from the drum inlet 22*b* toward the inlet 111. In addition, the connection body 22*d* may include an air outlet 22*e* formed to communicate with the duct unit 30.

As can be seen from FIG. 2, the air outlet 22*e* may be a passage for allowing internal air of the drum body 21 to flow into the duct unit 30, and may be implemented as a through-hole formed to pass through the connection body 22*d*.

The second support 23 may include a second fixed body 23*a* fixed into the cabinet 10, and a second support body 23*b* that is included in the second fixed body 23*a* and is inserted into the back surface of the drum body 21.

The second support 23 may include an air inlet 23*c* that is formed to pass through the second fixed body 23*a* such that the inside of the drum body 21 communicates with the inside of the cabinet 10.

In this case, the duct unit 30 may be configured to connect the air outlet 22*e* to the air inlet 23*c*.

The cylindrical drum body 21 may rotate through various shapes of drivers 50.

For example, the driver 50 shown in FIG. 2 may include a motor 51 fixed into the cabinet 10, a pulley 52 configured to rotate by the motor 51, and a belt 53 configured to connect a circumferential surface of the pulley 52 to a circumferential surface of the drum body 21.

In this case, the first support 22 may include a first roller R1 formed to rotatably support the circumferential surface of the drum body 21, and a second roller R2 formed to rotatably support the circumferential surface of the drum body 21.

However, the scope or spirit of the present disclosure is not limited thereto, a direct-driven type driver for rotating the drum by directly coupling the motor 51 to the drum without passing through the pulley and the belt can also be applied to the present disclosure within the scope of the present disclosure. A detailed description thereof will hereinafter be given with reference to one example of the driver 50.

The duct unit 30 may include an exhaust duct 31 connected to the air outlet 22*e*, a supply duct 32 connected to the air inlet 23*c*, and a connection duct 33 provided with the heat exchanger unit 40 installed therein so as to connect the exhaust duct 31 to the supply duct 32.

The heat exchanger unit 40 may be implemented as various devices capable of sequentially performing dehumidification and heating of air introduced into the duct unit 30. For example, the heat exchanger unit 40 may be provided as a heat pump system.

In the heat pump system, the heat exchanger unit 40 may include a circulation fan 43, a first heat exchanger (i.e., a heat absorption unit) 41, and a second heat exchanger (i.e., a heating unit) 42. The circulation fan 43 may enable the air to forcibly move along the duct unit 30. The first heat exchanger 41 may perform a dehumidification function by lowering humidity of the air introduced into the duct unit 30. The second heat exchanger 42 provided in the duct unit 30 may heat the air having passed through the first heat exchanger 41. The circulation fan 43 may include an impeller 43*a* provided in the duct unit 30, and an impeller motor 43*b* configured to rotate the impeller 43*a*

The impeller 43*a* may be installed in any one of the exhaust duct 31, the connection duct 33, and the supply duct 32. FIG. 2 illustrates an example of the impeller 43*a* provided in the connection duct 32 without being limited thereto. For convenience of description, the following description will hereinafter be given with reference to the example in which the impeller 43*a* is provided in the connection duct 32.

The first heat exchanger 41 and the second heat exchanger 42 may be sequentially arranged in the direction from the exhaust duct 31 to the supply duct 32 within the connection duct 33, and may be connected to each other through a refrigerant pipe 44 forming a circulation passage of the refrigerant.

The heat absorption unit implemented as the first heat exchanger 41 may transmit heat of the air introduced into the exhaust duct 31 to the refrigerant, thereby cooling the air and evaporating the refrigerant.

The heating unit implemented as the second heat exchanger 42 may transmit heat of the refrigerant having passed through the compressor 45 to the air, thereby heating the air and condensing the refrigerant.

In this case, moisture contained in the air may move along the surface of the first heat exchanger 41 while passing through the first heat exchanger 41, such that the moisture is collected at the bottom surface of the connection duct 33.

As described above, the heat exchanger unit 40 based on the heat pump system including the first heat exchanger 41 and the second heat exchanger 42 can be implemented as any one of known configurations, and a detailed description thereof will herein be omitted for convenience of description.

In order to collect condensate water collected at the bottom surface of the connection duct 33 after being condensed from the air having passed through the first heat exchanger 41, a water collection unit 60 may be provided in the laundry dryer 1.

The condensate water condensed in the first heat exchanger 41 may be primarily collected by the water collection unit 60, and may be secondarily collected by a reservoir unit 70. The water collection unit 60 may be provided in the connection duct 33, and may be separately provided in a space spaced apart from the connection duct 33.

The condensate water primarily collected by the water collection unit 60 may be supplied to the reservoir unit 70 through a condensate supply pipe 61. In this case, a condensate pump 62 for smoothly discharging the condensate water may be installed in the condensate supply pipe 61.

The reservoir unit 70 may include a reservoir tank 72 that can be drawn out from one side of the front panel 11 toward the outside. The reservoir tank 72 may be configured to collect condensate water received from the water collection unit 60 to be described later.

The user may withdraw the reservoir tank 72 from the cabinet 10 to remove condensate water from the reservoir tank 72, and may then mount the reservoir tank 72 to the cabinet 10. As a result, the laundry dryer according to the present disclosure may also be disposed in a place where a sewer or the like is not installed.

More specifically, the reservoir unit 70 may include a reservoir tank 72 and an inlet 72*a*. The reservoir tank 72 may be detachably coupled to the cabinet 10 to provide a space in which water is stored. The inlet 72*a* may be formed to pass through the reservoir tank 72 so that water discharged from the condensate supply pipe 61 is introduced into the reservoir tank 72.

The reservoir tank 72 may be formed in a drawer-shaped tank that is drawn out from the cabinet 10. In this case, the front panel 11 of the cabinet 10 may include a reservoir mounting hole in which the reservoir tank 72 is inserted.

A panel 71 may be fixed to the front surface of the reservoir tank 72. The panel 71 may be detachably coupled to the reservoir mounting hole to form some parts of the front panel 11.

The panel 71 may include a groove unit 71*a* into which a user hand is inserted such that the groove unit 71*a* can be grasped by the user hand. In this case, the panel 71 may serve as a handle that enables the reservoir tank 72 to be withdrawn from or inserted into the cabinet 10.

The inlet 72*a* may be formed to receive condensate water discharged from a condensate nozzle 63 fixed to the cabinet 10. The condensate nozzle 63 may be fixed to the top panel 13 of the cabinet 10 such that the condensate nozzle 63 is disposed over the inlet 72*a* when the reservoir tank 72 is inserted into the cabinet 10.

The user may withdraw the reservoir tank 72 from the cabinet 10, and may discard water stored in the reservoir tank 72 by turning over or tilting the reservoir tank 72 in the direction in which the inlet 72*a* is arranged. In order to easily discharge water stored in the reservoir tank 72 through the inlet 72*a*, a communication hole 72*b* may be formed to pass through the top surface of the reservoir tank 72.

In addition, the laundry dryer 1 according to the present disclosure may include a first filter unit F1 and a second filter unit F2 as a means for removing foreign materials such as lint or dust generated in a laundry drying process.

The first filter unit F1 may be provided in the exhaust duct 31 that primarily filters out foreign materials contained in the air discharged from the drum 20.

The second filter unit F2 may be disposed at a downstream side of the first filter unit F1 in a flow direction of air so as to secondarily filter out foreign materials contained in the air having passed through the first filter unit F1. More specifically, it may be preferable that the second filter unit F2 be disposed at an upstream side of the first heat exchanger 41 within the connection duct 33. As a result, foreign materials contained in the air can be prevented from being accumulated in the first heat exchanger 41 acting as a heat absorption unit, such that throughput degradation or pollution of the first heat exchanger 41 can also be prevented.

A detailed structure of the first filter unit F1 and the second filter unit F2 can be implemented as any means well known to those skilled in the art, and as such a detailed description thereof will herein be omitted for convenience of description.

Meanwhile, the laundry dryer 1 according to the present disclosure may further include a water supply unit 80 having an internal water supply unit 81 and an external water supply unit 82, and a steam unit 90 configured to generate steam by receiving water from the water supply unit 80.

The steam unit 90 may receive fresh water but not the condensate water, and may thus generate steam using the fresh water. In order to generate steam, the steam unit 90 may heat water, may use ultrasound, or may vaporize such water.

The steam unit 90 may receive water not only through the internal water supply unit 81 but also through the external water supply unit 82, such that steam can be supplied to the inside of the drum body 21.

The external water supply unit 82 may include a direct water-supply valve 82*a* adjacent or fixed to the back panel 13, and a direct water-supply pipe 82*b* for supplying the steam unit 90 with water received from the direct water-supply valve 82.

The direct water-supply valve 82*a* may be coupled to an external water-supply source. For example, the direct water-supply valve 82*a* may be coupled to a water supply pipe (not shown) extending to the back surface of the cabinet. For example, the direct water-supply valve 82*a* may be coupled to a water supply pipe (not shown) extending to the back surface of the cabinet. As a result, the steam unit 90 may be configured to directly receive water through the direct water-supply valve 82*a*.

Therefore, although the internal water-supply unit 81 is omitted or does not include water therein, the steam unit 90 may receive water required for steam generation through the direct water-supply valve 82*a* as necessary.

The direct water-supply valve 82*a* may be directly controlled by the steam controller 91.

Although the steam controller 91 can be installed in the control panel 117, the scope or spirit of the present disclosure is not limited thereto, and the steam controller 91 can also be implemented as a separate control panel to prevent overload of the control panel 117 and to prevent an increase in production costs. That is, the steam controller 91 may be included in a controller (not shown) disposed at the control panel 117 that controls commands of the input unit 118 and the display unit 119 and controls a command for performing a procedure of the laundry dryer 1.

In this case, the steam controller 91 may be arranged adjacent to the steam unit 90. The steam controller 91 may be mounted to the side panel 14 in which the steam unit 90 is installed, such that a control line connected to the steam unit 90 can be minimized in length.

Preferably, the steam unit 90 may be installed adjacent to the direct water-supply valve 82*a*. As a result, unnecessary residual water can be prevented from remaining in the direct water-supply valve 82*b*, and the steam unit 90 can immediately receive water as necessary.

On the other hand, the internal water-supply unit 81 may include a storage tank 810 for storing water therein, a supply pump 820 for receiving water from the storage tank 810 and supplying received water to the steam unit 90, and a tank housing 830 for providing a space in which the storage tank 810 and the supply pump 820 are arranged.

The top panel 13 may include a tank withdrawal hole 131 that is formed in a region corresponding to an installation portion of the storage tank 810.

The storage tank 810 is smaller in volume than the reservoir tank 72 of the reservoir unit 70, such that the storage tank 810 can be easily withdrawn upward. Accordingly, the storage tank 810 may be configured to be easily withdrawn upward from the top panel 13. As a result, since the withdrawal direction of the storage tank 810 is different from the withdrawal direction of the reservoir unit 70, the possibility of user confusion may be greatly reduced.

The top panel 13 may include a withdrawal cover 132 that shields the tank withdrawal hole 131 to prevent the storage tank 810 from being arbitrarily drawn out.

The withdrawal cover 132 may include a panel connection unit 133 coupled to an outer circumferential surface of the tank withdrawal hole 131. The panel connection unit 133 may extend from one side of the withdrawal cover 132 such that the withdrawal cover 132 can be rotatably coupled to the top panel 13. The panel connection unit 133 and the top panel 13 may be hinge-coupled to each other.

On the other hand, a panel handle 134 that can be grasped by the user may be mounted on the withdrawal cover 132. The panel handle 134 may be formed as a groove that is recessed downward from the withdrawal cover 132.

A constituent element for informing the user of a water shortage state of the laundry dryer and a method for controlling the laundry dryer to inform the user of a water shortage state according to the present disclosure will hereinafter be described with reference to the attached drawings.

Figure 3:
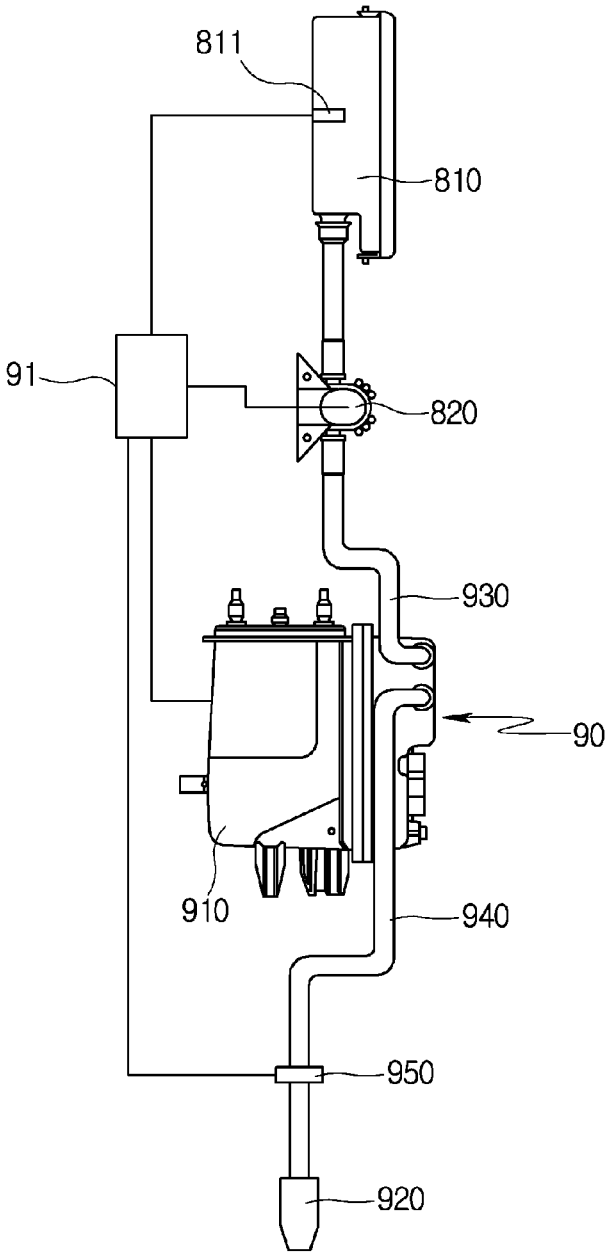
FIG. 3 is a schematic diagram illustrating an example of a connection state in which a storage tank, a supply pump, and a steam unit of the laundry dryer are coupled to each other according to the present disclosure.
Figure 4:
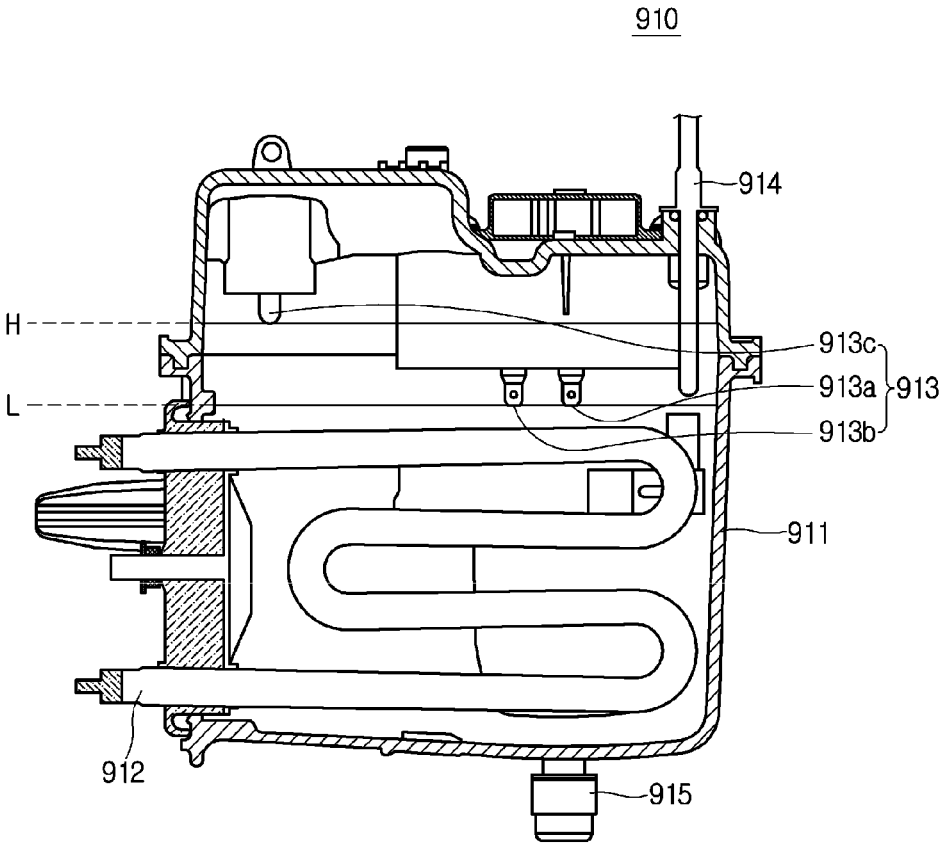
FIG. 4 is a cross-sectional view illustrating a steam generator of the laundry dryer according to the present disclosure.

FIG. 3 is a schematic diagram illustrating an example of a connection state in which the storage tank, the supply pump, and the steam unit of the laundry dryer are coupled to each other according to the present disclosure. FIG. 4 is a cross-sectional view illustrating the steam generator of the laundry dryer according to the present disclosure.

Referring to FIGS. 3 and 4, the steam unit 90 for generating steam to supply the drum 20 with steam may be connected to the storage tank 810 through the supply pump 820, and water stored in the storage tank 810 can flow into the steam unit 90 by activation of the supply pump 820.

The steam unit 90 may include a steam generator 910, a spray nozzle 920, a water supply pipe 930, and a steam discharge pipe 940. The steam generator 910 may store water received from the storage tank 810, and may generate steam. The spray nozzle 920 may spray steam generated by the steam generator 910 into the drum 20. The water supply pipe 930 may connect the supply pump 820 to the steam unit 90 in a manner that water stored in the storage tank 910 can flow into the steam generator 910. The steam discharge pipe 940 may connect the steam generator 910 to the spray nozzle 920 such that steam generated by the steam generator 910 can be supplied to the spray nozzle 920.

The steam unit 90 may further include a shut-off valve 950 provided in the steam discharge pipe 940. The shut-off valve 950 may shield (open or close) the steam discharge pipe 940 such that steam is supplied to the spray nozzle 920 or is not supplied to the spray nozzle 920.

In this case, the supply pump 820 and the shut-off valve 950 can be controlled by the steam controller 91.

In more detail, the steam generator 910 may generate steam by heating water stored in the storage tank. The steam generator 910 may include a steam housing 911 formed to store water received from the storage tank 810, a heater 912 configured to heat water stored in the steam housing 911, and a water level sensor 913 configured to measure a water level of water stored in the steam housing 911.

In addition, the steam generator 910 may further include a temperature sensor 914 to measure a temperature of water stored in the steam housing 911. The steam generator 910 may further include a pass pipe 915 provided in the steam housing 911 such that the steam generator 910 may discharge residual water stored in the steam housing 911 through the pass pipe 915 or may discharge water or steam through the pass pipe 915.

The steam controller 91 may receive signals from the water level sensor 913 and the temperature sensor 914, and may thus control the supply pump 820, the heater 912, and the shut-off valve 950 using the received signals.

For example, upon receiving a steam supply command, the steam controller 91 may recognize that a water level of water stored in the steam housing 911 reaches a target water level (H) using the water level sensor 913. If the water level of water stored in the steam housing 911 does not reach the target water level (H), the steam controller 91 may operate the supply pump 820. If the steam controller 91 recognizes that the water level of water stored in the steam housing 911 has reached the target water level (H) based on data received from the water level sensor 913, the steam controller 91 may control the supply pump 820 to stop operation.

If the water level of water stored in the steam housing 911 reaches the target water level (H), the steam controller 91 may operate the heater 912, may recognize that steam is generated in the steam housing 911 based on output data of the temperature sensor 914, and may open the shut-off valve 950, such that steam can be supplied into the drum through the spray nozzle 920.

If it is determined that a water level of at least one of water stored in the steam unit 90 and water stored in the storage tank 810 is equal to or less than a predetermined water level, the steam controller 91 may provide a water shortage notification message such that the user who views the water shortage notification message can recognize a water shortage state of the laundry dryer 1.

In this case, the water shortage notification message can be recognized by the user through at least one of the display panel and the speaker. That is, the display unit 119 may include at least one of a display panel capable of displaying characters, figures, etc. and the speaker capable of outputting a voice signal and a sound signal. Therefore, the water shortage notification message may be displayed on the display unit 119 using at least one of characters, figures, voice signals, and sound signals, such that the user can recognize the water shortage state of the laundry dryer.

In addition, the storage tank 810 may include a storage-tank water level sensor 811 configured to sense a water level of water stored in the storage tank 810. The storage-tank water level sensor 811 may recognize the water level of water stored in the storage tank 810 using various water level measurement methods well known to those skilled in the art. For example, the storage-tank water level sensor 811 may recognize the water level of water stored in the storage tank 810 by measuring the weight of the storage tank 810, or may recognize the water level of water stored in the storage tank 810 by sensing the height of a structure, the height of which is changed in response to the water level.

Therefore, the steam controller 91 may measure the water level of water stored in the storage tank 810 using the storage-tank water level sensor 811, and may measure the water level of water stored in the steam housing 911 using the water level sensor 913 of the steam unit 90. If the water level of at least one of water stored in the storage tank 810 and water stored in the steam housing 911 is equal to or less than a predetermined water level, a water shortage notification message can be displayed on the display unit 119 by the steam controller 91.

More specifically, if a steam supply command is input to the steam controller 91 after execution of the drying operation, the steam controller 91 may operate the steam unit 90 to supply steam to the drum 20. If steam is completely sprayed into the drum 20, the steam controller 91 may operate the supply pump 820 until a water level of water stored in the steam housing 911 reaches the target water level (H) such that the supply pump 820 can be controlled to supply water to the steam housing 911.

In this case, when the water level of water stored in the steam housing 911 does not reach the target water level (H) after lapse of a predetermined time from an operation start time of the supply pump 820, the steam controller 91 may determine that there is no water in the storage tank 810.

Of course, the steam controller 91 may receive load data of the supply pump 820, and may determine whether a predetermined time (e.g., 5~10 seconds) has elapsed from a specific time where load is not supplied to the supply pump 820. After lapse of the predetermined time (e.g., 5~10 seconds), if no load is supplied to the supply pump 820 and at the same time the water level of water stored in the steam housing 911 does not reach the target water level (H), the steam controller 91 may determine a water shortage state of the storage tank 810. In this case, load data can be recognized through a change in current applied to the supply pump 820.

Moreover, if the steam controller 91 determines a water shortage state of the storage tank 810, the steam controller 91 may display a water shortage notification message at any one of a first time where the water shortage state of the storage tank 810 is determined and a second time where a subsequent steam supply command is input. In other words, as soon as the water shortage state is determined, the steam controller 91 may immediately display the water shortage notification message. Alternatively, if the steam supply command is input to the steam controller 91 after execution of the next drying operation, the steam controller 91 may display the water shortage notification message such that the user can recognize the water shortage state of the storage tank 810. Of course, as soon as the water shortage state of the storage tank 810 is determined, the water shortage notification message is immediately displayed. Thereafter, when the subsequent steam supply command is input to the steam controller 91, the water shortage notification message may be displayed again by the steam controller 91.

The water level sensor 913 provided in the steam housing 911 may include a low water level sensor for measuring a minimum water level (L) to be stored in the steam housing 911, and a high water level sensor for measuring a target water level (H) to be stored in the steam housing 911 for steam generation For example, the water level sensor 913 may include a low water level electrode 913*b*, a high water level electrode 913*c*, and a common electrode 913*a*. The low water level electrode 913*b* may be installed at a position corresponding to the minimum water level (L) to be stored in the steam housing 911. The high water level electrode 913*c* may be installed at a position corresponding to the target water level (H) to be stored in the steam housing 911 for steam generation. The common electrode 913*a* may be installed at a position that is identical to or lower than that of the low water level electrode 913*b*, may be electrically coupled to at least one of the low water level electrode 913*b* and the high water level electrode 913*c* through water stored in the steam housing 911, and may thus recognize the water level of water stored in the steam housing 911.

In this case, the low water level electrode 913*b* may be arranged at an upper side of the heater 912 within the steam housing 911. That is, the low water level electrode 913*b* may be arranged at an upper side of the heater 912 in a manner that the heater 912 can always be immersed in the water within the steam housing 911.

Through the above-mentioned configurations, if the steam controller 91 determines that the water level of water stored in the steam housing 911 does not satisfy the minimum water level (L) based on data received from the common electrode 913*a* and the low water level electrode 913*b*, the steam controller 91 may operate the supply pump 820 without receiving the steam supply command, such that the minimum water level (L) can always be satisfied in the steam housing 911. That is, in a situation in which the heater 912 is exposed outside without being immersed in water, if the heater 912 operates, the steam housing 911 may be heated and melted, resulting in occurrence of a fire. In order to address the above-mentioned issues, the steam housing 911 may be filled with water corresponding to a minimum water level (L) so that the heater 912 can always be immersed in water within the steam housing 911.

After steam supply is completed, the steam controller 91 may operate the supply pump 820 in a manner that water required for subsequent steam generation can be prestored in the steam housing 911. Thereafter, the steam controller 91 may control the supply pump 820 in a manner that the steam housing 911 can be filled with water corresponding to the target water level (H) through the common electrode 913*a* and the high water level electrode 913*c*.

In other words, upon receiving a steam supply command, the steam controller 91 may not supply water to the steam housing 911 by driving the supply pump 820, and may allow the steam housing 911 to always be filled with water corresponding to the target water level (H) for steam generation. Thus, in a situation in which the steam housing 911 is filled with water corresponding to the target water level (H), if a steam supply command is input to the steam controller 91, the steam controller 91 may generate and supply steam by operating the heater 912, and may operate the supply pump 820 so that the steam housing 911 can be filled with water corresponding to the target water level (H). In this case, if the steam housing 911 is not filled with water corresponding to the target water level (H), the steam controller 91 may display a water shortage notification message for user recognition.

Through the above-mentioned configurations, if it is necessary to display the water shortage notification message in a situation in which the steam housing 911 is not filled with water corresponding to the target water level (H), the water shortage notification message may be displayed in a situation in which the amount of water stored in the storage tank 810 is minimized, such that the number of times that the user should refill the storage tank 810 with water can be minimized, resulting in an increase in user convenience.

When the water level of water stored in the storage tank 810 is measured using the storage-tank water level sensor 811 installed in the storage tank 810, a specific state in which at least a predetermined amount of water is stored in the storage tank 810 may be determined to be a minimum water level according to measurement methods and structures of the storage-tank water level sensor 811.

For example, assuming that the storage-tank water level sensor is implemented as a reed switch, a specific state in which 250~350 mL of water remains in the storage tank may be determined to be a minimum water level due to a restricted sensing range of the reed switch acting as the sensor. As a result, although 250~350 mL of water remains in the storage tank, the reed switch acting as the storage-tank water level sensor should unavoidably inform the user of a water shortage state of the storage tank, such that the user who recognizes the water shortage state has to replenish the storage tank with water, resulting in occurrence of user inconvenience.

In contrast, according to the embodiments of the present disclosure, even when residual water stored in the storage tank 810 does not satisfy the target water level (H) of the steam housing 911, the supply pump 820 may operate in a manner that water stored in the storage tank 810 flows into the steam housing 911. Thereafter, only when water capable of being supplied to the storage tank 810 through the supply pump 820 does not remain in the storage tank 810, the water shortage notification message is displayed for user recognition. As a result, the number of times that the user should replenish the storage tank 810 with water can be minimized, resulting in an increase in user convenience.

Of course, in order to more correctly inform the user of the water shortage state, the laundry dryer according to the present disclosure may display the water shortage notification message for user recognition only when both the storage-tank water level sensor 811 and the water level sensor 913 of the steam unit 90 detect the water shortage state.

A method for controlling the laundry dryer according to the present disclosure will hereinafter be described with reference to the attached drawings.

Figure 5:
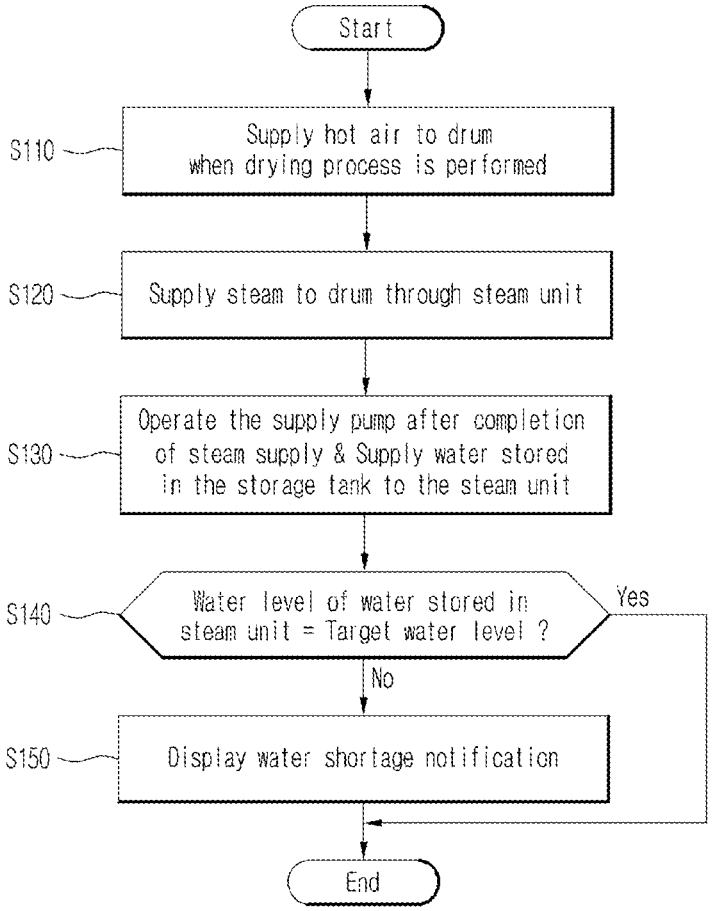
FIGS. 5 and 6 are flowcharts illustrating methods for controlling the laundry dryer according to the present disclosure.
Figure 6:
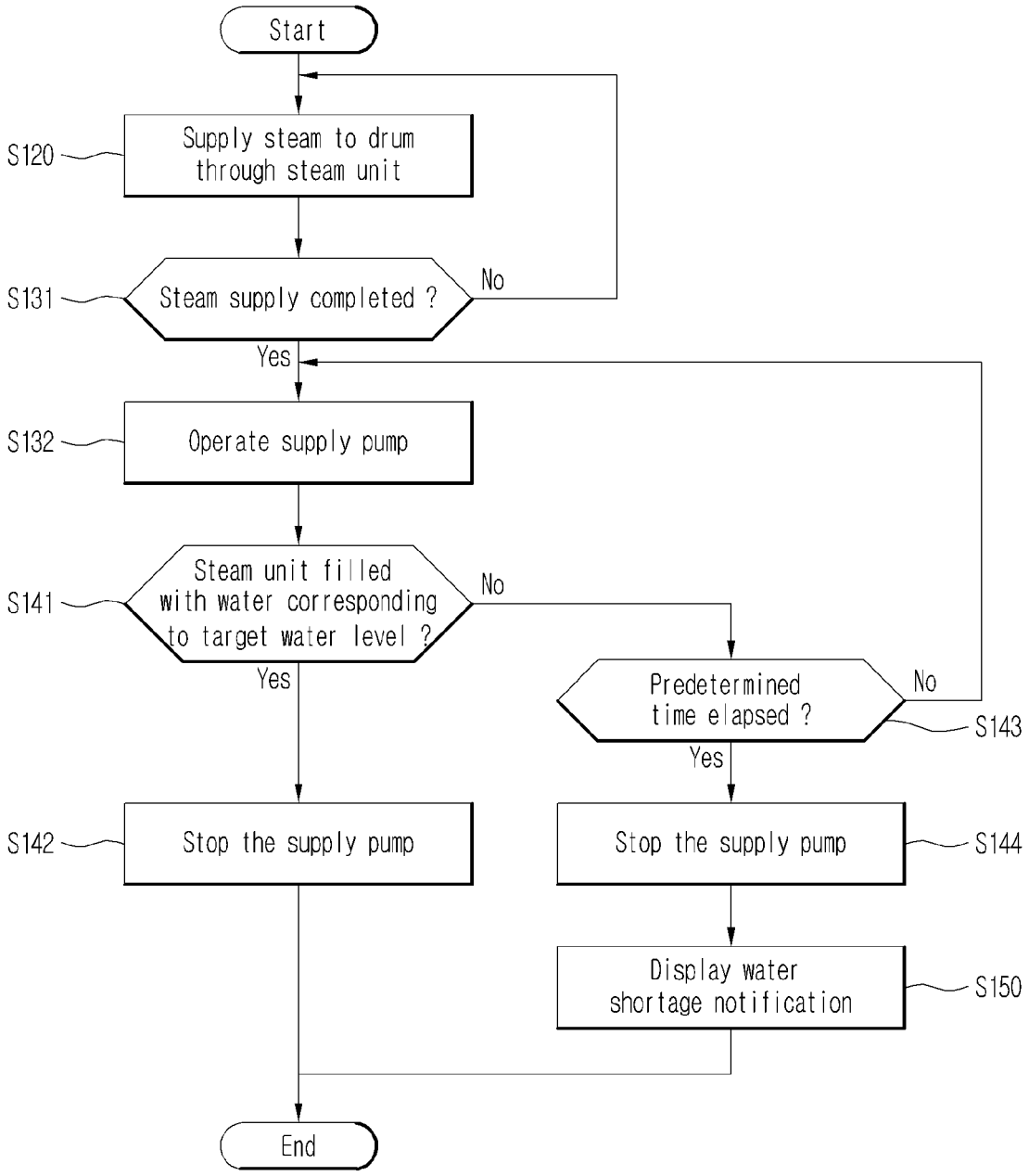

FIGS. 5 and 6 are flowcharts illustrating methods for controlling the laundry dryer according to the present disclosure.

Referring to FIGS. 5 and 6, a method for controlling the laundry dryer may include a hot-air supply step S110, a steam supply step S120, a water supply step S130, a water shortage determination step S140, and a water shortage notification step S150. In the hot-air supply step S110, when the drying process of laundry is performed, the laundry dryer may supply hot air to the drum. In the steam supply step S120, when the drying process of laundry is performed, the laundry dryer may supply steam to the drum through the steam unit. In the water supply step S130, the laundry dryer may operate the supply pump after completion of steam supply, such that water stored in the storage tank is supplied to the steam unit. In the water shortage determination step S140, after water is completely supplied to the steam unit, if a water level of at least one of water stored in the steam unit and water stored in the storage tank is equal to or less than a predetermined water level, the laundry dryer may determine occurrence of the water shortage state. In the water shortage notification step S150, the laundry dryer may display the water shortage notification message for user recognition.

In other words, according to the method for controlling the laundry dryer, upon receiving the steam supply command, the laundry dryer may not supply water to the steam unit by operating the supply pump, and may operate the supply pump after completion of steam supply so that water stored in the storage tank is supplied to the steam unit in a manner that the steam unit can be pre-filled with water corresponding to a target water level. In this case, when the steam unit is not filled with water corresponding to the target water level, the laundry dryer may determine a water shortage state of the storage tank, and may display a water shortage notification message.

In the water supply step S130, the laundry dryer may supply water to the steam unit by continuously operating the supply pump until a water level of water stored in the steam unit satisfies the target water level. If the target water level is satisfied or if a predetermined time has elapsed from activation of the supply pump, the laundry dryer may control the supply pump to stop operation.

Referring to FIG. 6, if steam is supplied to the drum through the steam unit (S120), and if steam is completely supplied to the drum (Yes in S131), the laundry dryer operates the supply pump (S132) to fill the steam unit with water, such that water stored in the storage tank can be supplied to the steam unit. For example, the supply of steam to the drum can be completed when a preset steam supply operation has been finished or when a preset time has been elapsed after a start time point of the supply of steam to the drum. In some cases, the supply of steam to the drum can be completed when the steam unit becomes empty.

If the steam unit is filled with water corresponding to the target water level (Yes in S141), the supply pump may stop operation (S142). That is, after completion of such steam supply, the steam unit can be filled with water corresponding to the target water level.

At this time, after the supply pump is driven (S132), in a situation in which the steam unit is not filled with water corresponding to the target water level (No in S141), if a predetermined time has elapsed (Yes in S143) from the above situation, the supply pump may stop operation (S144), and may display a water shortage notification message (S150).

For example, assuming that a time of about 10 seconds is required until the steam unit is filled with water corresponding to the target water level, although a time of about 15~20 seconds has elapsed from an operation start time of the supply pump, if the steam unit is not yet filled with water corresponding to the target water level, this means a water shortage state of the storage tank, such that a water shortage notification message is then displayed for user recognition. Of course, the above-mentioned time is merely an example for convenience of description, the scope of the present disclosure is not limited thereto, and the above-mentioned time can also be changed according to various conditions, for example, capacity of the steam unit, the amount of water to be supplied, capacity of the supply pump, etc.

Alternatively, as another example, the laundry dryer may measure a current applied to the supply pump, may measure load supplied to the supply pump based on a change in the current applied to the supply pump. Although a time of about 5~10 seconds has elapsed from a reference time where no load is applied to the supply pump, if load is not applied to the supply pump and at the same time the steam unit is not filled with water corresponding to the target water level, this means a water shortage state of the storage tank, such that a water shortage notification message may be displayed for user recognition.

Moreover, in the water shortage determination step S140, the laundry dryer may receive information about a water level of water stored in the storage tank using the storage-tank water level sensor installed in the storage tank, may receive information about a water level of water stored in the steam unit, and may then determine a water shortage state based on the received information. That is, in the water shortage determination step S140, if it is determined that the water level of water stored in the storage tank is equal to or less than a predetermined water level and the water level of water stored in the steam unit does not satisfy the target water level, this means a water shortage state. As a result, the laundry dryer may recognize both the water level of water stored in the storage tank and the water level of water stored in the steam unit, such that a water shortage state of the laundry dryer can be more correctly determined based on the recognized water levels.

In the water shortage notification step S150, the laundry dryer may display the water shortage notification message for user recognition using at least one of the display panel and the speaker. That is, the display unit of the laundry dryer may include at least one of the display panel for displaying characters, figures, etc., and the speaker capable of outputting voice signals and sound signals. Therefore, the water shortage notification message may be displayed on the display unit using at least one of characters, figures, voice signals, and sound signals, such that the user can recognize the water shortage state through the water shortage notification message.

In the water shortage notification step S150, if the water shortage state is determined in the water shortage determination step S140, the laundry dryer may display the water shortage notification message at any one of a first time where the water shortage state is determined and a second time where a subsequent steam supply command is input.

In other words, as soon as the water shortage state is determined in the water shortage determination step S140, the laundry dryer may immediately display the water shortage notification message. Alternatively, if the steam supply command is input to the laundry dryer after execution of the next drying operation, the laundry dryer may display the water shortage notification message so that the user can recognize the water shortage state. Of course, in the water shortage notification step S150, as soon as the water shortage state is determined, the laundry dryer may immediately display the water shortage notification message. Subsequently, when the subsequent steam supply command is input to the laundry dryer, the water shortage notification message may be displayed again. In addition, characters or figures indicating the water shortage state may be continuously displayed on the display panel as needed.

According to the method for controlling the laundry dryer, if a new drying process command is input to the laundry dryer after completion of the water shortage notification step S150, the laundry dryer may proceed to the hot-air supply step only when the water level of water stored in the steam unit satisfies a target water level.

For example, if the steam unit is not filled with water corresponding to the target water level, the water shortage notification message may be displayed. Thereafter, after the user who recognizes the water shortage notification message replenishes the storage tank with water, if a new drying process command is input to the laundry dryer, the laundry dryer may supply water corresponding to the target water level to the steam unit 90 by operating the supply pump, and may then proceed to the steam supply step.

In another example, although the water shortage notification message is displayed in a situation in which the steam unit is not filled with water corresponding to the target water level, if the user does not replenish the storage tank with water, and if a new drying process command is then input, the water shortage notification message may be displayed again. If the storage tank is replenished with water, the laundry dryer may operate the supply pump in a manner that the steam unit 90 can be filled with water corresponding to the target water level, and may then proceed to the above-mentioned steam supply step.

The laundry dryer and the method for controlling the same according to the present disclosure may control the steam housing to continuously receive water from the storage tank until the water level of water stored in the steam housing satisfies the target water level for steam generation. If the water level of water stored in the steam housing does not satisfy the target water level, the water shortage notification message may be displayed. As a result, the water shortage notification message may be displayed in a situation in which the amount of the residual water stored in the storage tank is minimized, such that the number of times that the user should refill the storage tank with water can be minimized, resulting in an increase in user convenience.

As is apparent from the above description, the laundry dryer and the method for controlling the same according to the embodiments of the present disclosure can determine a specific state in which a water level of water stored in the storage tank does not reach a target water level for enabling a steam unit to generate steam, to be a water shortage state, and can inform the user of a water shortage notification message after minimizing the amount of residual water stored in the storage tank. As a result, the number of times that the user should refill the storage tank with water can be minimized, resulting in an increase in user convenience.

The laundry dryer and the method for controlling the same according to the embodiments of the present disclosure can indirectly recognize the amount of water stored in the storage tank based on the amount of water supplied to the steam unit even when the water level sensor installed in the storage tank malfunctions or abnormally operates, such that occurrence of a water shortage notification message caused by a failure or malfunction of the water level sensor for the storage tank can be prevented.

In addition, the laundry dryer and the method for controlling the same according to the embodiments of the present disclosure can determine both a water level of water stored in the storage tank and a water level of water stored in the steam unit in response to data received from the water level sensor installed in the storage tank, such that the amount of residual water stored in the storage tank can be more correctly determined.

It will be apparent to those skilled in the art that various modifications and variations can be made in the present disclosure without departing from the spirit or scope of the inventions. Thus, it is intended that the present disclosure covers the modifications and variations of this invention provided they come within the scope of the appended claims and their equivalents.

What is claimed is:

1. A laundry dryer comprising:

a cabinet;

a drum disposed in the cabinet and configured to receive hot air or steam or both;

a steam unit disposed in the cabinet and configured to generate the steam;

a storage tank disposed in the cabinet and configured to store water;

a supply pump disposed between the steam unit and the storage tank, the supply pump being configured to supply the water stored in the storage tank to the steam unit; and a steam controller configured to:

operate the steam unit based on receiving a steam supply command for supplying the steam to the drum, determine a water level of water in the steam unit or the storage tank, based on completion of supply of steam into the drum, operate the supply pump to thereby supply water in the storage tank to the steam unit to a predetermined target water level of the steam unit, determine a water shortage state of the storage tank based on the water level in the steam unit being less than the predetermined target water level after supplying the water to the steam unit for a predetermined time from an operation start time of the supply pump, and based on the water level of water in the steam unit or the storage tank being less than or equal to the predetermined target water level, output a water shortage notification.

2. The laundry dryer according to claim 1, wherein the steam controller is configured to:

output the water shortage notification based on determining the water shortage state of the storage tank or based on receiving a subsequent steam supply command after determining the water shortage state of the storage tank.

3. The laundry dryer according to claim 1, wherein the steam unit comprises:

a steam generator configured to store water supplied from the storage tank and to generate the steam;

a spray nozzle configured to spray the steam generated by the steam generator into the drum;

a water supply pipe that connects the supply pump to the steam unit and is configured to supply water from the storage tank to the steam generator; and a steam discharge pipe that connects the steam generator to the spray nozzle and is configured to supply the steam generated by the steam generator to the spray nozzle.

4. The laundry dryer according to claim 3, wherein the steam generator comprises:

a steam housing configured to receive water from the storage tank;

a heater configured to heat water in the steam housing; and a water level sensor configured to sense a water level of water in the steam housing.

5. The laundry dryer according to claim 4, wherein the water level sensor comprises:

a low water level sensor configured to detect whether the water level of water stored in the steam housing is greater than or equal to a minimum water level that is predetermined to maintain the heater in the water stored in the steam housing; and a high water level sensor configured to detect whether the water level of water stored in the steam housing corresponds to a target water level that is predetermined for steam generation.

6. The laundry dryer according to claim 5, wherein the low water level sensor comprises a low water level electrode disposed at a position corresponding to the minimum water level, wherein the high water level sensor comprises a high water level electrode disposed at a position corresponding to the target water level, and wherein the water level sensor further comprises a common electrode disposed at a position vertically lower than or equal to the position of the low water level electrode, the common electrode being electrically connected to at least one of the low water level electrode or the high water level electrode through the water stored in the steam housing and configured to detect the water level of water stored in the steam housing.

7. The laundry dryer according to claim 5, wherein the steam controller is configured to:

determine the water level of water stored in the steam housing after supplying water to the steam unit for a predetermined time from an operation start time of the supply pump; and output the water shortage notification based on the water level of water stored in the steam housing being less than the target water level after supplying the water to the steam unit for the predetermined time from the operation start time of the supply pump.

8. The laundry dryer according to claim 5, wherein the steam controller is configured to:

based on the water level of water stored in the steam housing being less than the minimum water level, operate the supply pump to thereby supply water to the steam housing to a level greater than or equal to the minimum water level.

9. The laundry dryer according to claim 1, wherein the steam controller is configured to output the water shortage notification through at least one of a display panel or a speaker.

* * * * *